US007788735B1

(12) United States Patent
Foulks

(10) Patent No.: US 7,788,735 B1
(45) Date of Patent: Sep. 7, 2010

(54) UNDER CAPE PROTECTOR

(76) Inventor: Thomas L. Foulks, 812 Anders Dr., Columbia, SC (US) 29203

( * ) Notice: Subject to any disclaimer, the term of this patent is extended or adjusted under 35 U.S.C. 154(b) by 139 days.

(21) Appl. No.: 12/214,568

(22) Filed: Jun. 20, 2008

(51) Int. Cl.
*A41D 13/04* (2006.01)

(52) U.S. Cl. ..... 2/50

(58) Field of Classification Search ..... 2/50, 2/52, 48, 49.1–49.5, 51, 46, 88, 104, 102, 2/92, 91, 129, 131, 132, 135, 207; D2/861, D2/862

See application file for complete search history.

(56) References Cited

U.S. PATENT DOCUMENTS

| | | | | | |
|---|---|---|---|---|---|
| 1,165,533 | A | * | 12/1915 | Nelson | 2/50 |
| 1,464,546 | A | * | 8/1923 | Spero | 2/50 |
| 2,114,922 | A | * | 4/1938 | Glasmann | 2/48 |
| 2,698,944 | A | * | 1/1955 | Ramsby | 2/174 |
| 2,987,730 | A | * | 6/1961 | Walker | 2/174 |
| 3,031,676 | A | * | 5/1962 | Larson | 2/50 |
| 4,458,364 | A | | 7/1984 | Fenninger et al. | |
| 4,710,980 | A | | 12/1987 | Brison et al. | |
| 5,079,777 | A | | 1/1992 | Fowler et al. | |
| 5,181,274 | A | * | 1/1993 | DeFiore | 2/46 |
| 5,230,100 | A | * | 7/1993 | Lock-Jones | 2/50 |
| 5,572,740 | A | * | 11/1996 | Geniesse | 2/46 |
| 5,953,753 | A | | 9/1999 | Perez | |
| 6,195,799 | B1 | | 3/2001 | Davies | |
| 6,868,554 | B1 | | 3/2005 | Melvin | |
| 2003/0088902 | A1 | * | 5/2003 | Levy | 2/50 |
| 2004/0049828 | A1 | * | 3/2004 | Moses | 2/50 |
| 2007/0022509 | A1 | * | 2/2007 | Bloom et al. | 2/49.1 |
| 2007/0277280 | A1 | * | 12/2007 | Kelly | 2/48 |

* cited by examiner

*Primary Examiner*—Amy B Vanatta
(74) *Attorney, Agent, or Firm*—Montgomery Patent and Design, LLC; Robert C. Montgomery; Joseph T. Yaksich

(57) ABSTRACT

A device designed to protect a user's clothing from spills and mishaps is placed underneath a vinyl protector commonly used in beauty salons during shampooing and other hair and beauty treatments. When used in this manner, it provides additional protection for a user's clothing and ensures that water and other liquids that get underneath the vinyl protector will not contact the wearer's clothing. It is comprised of a soft absorbent material such as terry cloth and fastens about a neck of the user with the aid of a fastener system. It is perfect for eating messy foods in the home, in restaurants, or in locations where eating is awkward, such as in the car. It is also ideal for the elderly, the physically disabled, or others with diminished coordination that may frequently soil their clothes while eating.

17 Claims, 7 Drawing Sheets

UNDER CAPE PROTECTOR

RELATED APPLICATIONS

The present invention was first described in a notarized Official Record of Invention on Mar. 23, 2007, that is on file at the offices of Montgomery Patent and Design, LLC, the entire disclosures of which are incorporated herein by reference.

FIELD OF THE INVENTION

The present invention relates generally to a bib for adults and, more particularly, to a bib designed to be placed underneath a vinyl protector commonly used in beauty salons during shampooing and other hair and beauty treatments to protect a user's clothing, comprising a soft absorbent material that fastens about a neck of a user with the aid of a fastener system.

BACKGROUND OF THE INVENTION

Just about all of us have had the occasion where spilled food or beverage has ruined a shirt, tie, dress, blouse or other apparel. Whether the spill was caused by extremely messy food or just a simple accident, the outcome is always the same: the clothing must be cleaned and/or changed. This not only consumes valuable time, it results in higher cleaning costs and additional wear and tear on the clothing. If the clothing should be permanently stained, the cost to replace the item increases greatly. Additionally, those who frequently soil clothing, such as the elderly, the physically disabled, or those with diminished coordination skills must bear correspondingly higher cleaning costs. Finally, many clothes are ruined during hair care and beauty treatments commonly performed in a beauty shop. Such damage occurs when water, chemicals, and other liquids get underneath the vinyl protector and contact the clothing. Accordingly, there exists a need for a means by which soiled clothing resulting from food or beverage spills, or as a result of hair care and beauty treatments, can be avoided in a simple, easy and effective manner. The development of the invention herein fulfills this need.

The present invention is an adult bib comprising a soft absorbent material such as terry cloth that fastens about a neck of a user with the aid of a fastener system. The bib comprises a towel cape, a cape absorbent layer, a cape liquid repellent layer, a first flap, a second flap, a neck band, a neck band absorbent layer, a neck band liquid repellant layer, a neck strip, a hook fastener, and a loop fastener. The cape absorbent layer and the neck band absorbent layer are comprised of a soft, absorbent material such as terry cloth or the like. The cape liquid repellent layer, and the neck band liquid repellant layer, are comprised of material such as, but not limited to: vinyl, Gortex®, or the like. The neck band has hook-and-loop fasteners such as Velcro® attached to the distal ends such that the hook fastener is sewn onto one end and a loop fastener is sewn onto the other end. However, it may also have fasteners such as, but not limited to: metal hook fasteners, magnetic fasteners, snap fasteners, or the like. The fasteners allow the bib to be fastened around the neck of a user. The neck band has a neck band absorbent layer and a neck band liquid repellent layer sewn together such that the neck band absorbent layer is on the outside. A neck strip comprised of materials such as vinyl is sewn to the neck band absorbent layer on to the outside of the neck band and covers the portion of the neck band that is over the user's back when the bib is in place; however, other materials similar to vinyl may be used. The towel cape and the neck band are sewn together such that the ends of the neck band extend beyond the inside edge of the first flap and the inside edge of the second flap and the cape absorbent layer and the neck band absorbent layer are on one side and the cape liquid repellent layer and the neck band liquid repellent layer are on the opposite side. The cape absorbent layer and the cape liquid repellant layer are also sewn together along the inside edge of the first flap and the inside edge of the second flap from the neck band down to the bottom edge of the first flap and to the bottom edge of the second flap. The cape absorbent layer and the cape liquid repellant layer are also sewn together for approximately half way along the outside edge of the first flap, starting at the bottom edge of the first flap, and approximately half way along the outside edge of the second flap, starting at the bottom edge of the second flap. The bib is perfect for eating messy foods in the home, in restaurants or in locations where eating is awkward such as in the car. It is also ideal for the elderly, the physically disabled, or others with diminished coordination that may frequently soil their clothes while eating. The use of the present invention provides a simple and time-proven solution for clothing that is soiled while eating.

Several attempts have been made in the past to provide adult bibs. U.S. Pat. No. 6,868,554, issued in the name of Melvin, describes a hair salon accessory garment for directing hair and water downwardly and away from a user's neck. Unlike the present invention, the Melvin device has an inner layer separate from an outer layer. Furthermore, there are no absorbent or repellant layers on the neck portion of the Melvin device.

U.S. Pat. No. 6,195,799, issued in the name of Davies, discloses a neck protector apparatus comprising a cushioned pad to protect a user's head from a salon sink. However, the Davies apparatus serves a different purpose then the present invention and does not protect a user's clothing from water and other liquids during shampooing and other hair and beauty treatments.

U.S. Pat. No. 5,953,753, issued in the name of Perez, discloses a cape for hair cutting which prevents cut hair from clogging the neck closure and has resiliently connected toys inside to occupy children while they get their hair cut. The Perez device only shields the neck opening of the cape from having loose cut hair from becoming lodged therein.

U.S. Pat. No. 5,572,740, issued in the name of Geniesse, discloses a garment for protecting clothing. However, the Geniesse garment does not disclose a garment having an absorbent layer sewn together with a liquid impermeable layer.

U.S. Pat. No. 5,079,777, issued in the name of Fowler et al., discloses a protective cover for use in hair salons wherein a small separate top cover is secured about a person's neck at a position above the collar portion of a hair dressing cape. However, the Fowler et al. cover only has a waterproof material and does not have both an absorbent layer and a liquid repellant layer sewn together.

U.S. Pat. No. 4,710,980, issued in the name of Brison et al., discloses a protecting garment used in hairdressing salons comprising an overall or cape wrapped around a user's body and a towel adapted to the overall. However, the Brison et al. garment only has the absorbent towel layer.

U.S. Pat. No. 4,458,364, issued in the name of Fenninger et al., discloses a disposable towel for hairdressing salons and beauty parlors. However, unlike the present invention, the Fenninger et al. patent is a disposable towel.

None of the prior art particularly describes a bib designed to be placed underneath a vinyl protector commonly used in beauty salons during shampooing and other hair and beauty treatments to protect a user's clothing from spills and mishaps comprising a soft absorbent material such as terry cloth that fastens about a neck of a user with the aid of a fastener system. Accordingly, there exists a need for a means by which soiled clothing resulting from food or beverage spills, or as a result of hair care and beauty treatments, can be avoided in a simple, easy and effective manner without the disadvantages as described above.

SUMMARY OF THE INVENTION

In view of the foregoing disadvantages inherent in the prior art, it has been observed that there is need for a bib designed to be placed underneath a vinyl protector commonly used in beauty salons during shampooing and other hair and beauty treatments to protect a user's clothing from spills and mishaps comprising a soft absorbent material such as terry cloth that fastens about a neck of a user with the aid of a fastener system.

It is an object of the present invention to protect a user's clothing from spills and mishaps.

A further object of the present invention is to provide additional protection for a user's clothing and ensure that water and other liquids will not contact the user's clothing.

Yet still another object of the present invention is to protect a user's clothing from eating messy foods at home, in a restaurant, or in other locations where eating is awkward, such as in the car.

Still yet another object of the present invention is to protect the clothes of elderly people, physically disabled people, or others with diminished coordination that may frequently soil their clothes while eating.

To achieve the above objectives, it is an object of the present invention to provide a bib to protect a user's clothing from spills and mishaps comprising a towel cape, a neck band, a neck strip, a cape absorbent layer, and a neck band absorbent layer.

A further object of the present invention is having the towel cape comprise a first flap, a second flap, and the cape absorbent layer.

Another object of the present invention is having the neck band comprising a first end and a second end opposite the first end and the neck band further comprises the neck band absorbent layer and a fastener system attached to said first end and said second end to removably secure the bib about a neck of a user.

Yet another object of the present invention is having the neck strip sewn to the neck band absorbent layer on to an outside portion of the neck band and the neck strip covers a portion of the neck band that is over a user's back when the bib is in place.

Still yet another object of the present invention is having the towel cape and the neck band sewn together such that the first end and the second end of the neck band extend beyond a first inside edge of the first flap and a second inside edge of the second flap and the cape absorbent layer and the neck band absorbent layer are on one side.

Still another object of the present invention is having the bib further comprise a hook fastener located on the first end of the neck band and a loop fastener located on the second end of the neck band.

Still yet another object of the present invention is having the cape absorbent layer made of a soft, absorbent material such as terry cloth or a similar material.

Yet another object of the present invention is having the neck band absorbent layer made of a soft, absorbent material such as terry cloth or a similar material.

Yet still another object of the present invention is having the neck strip made of a vinyl or similar material.

Still yet another object of the present invention is having the fastener system comprise a hook fastener located on the first end of the neck band, a loop fastener located on the second end of the neck band, and the hook fastener engages the loop fastener when the first end and the second end of the neck band are pressed together thereby affixing the first end and the second end of the neck band together.

Yet another object of the present invention is having the fastener system comprise metal hook fasteners, magnetic fasteners, snap fasteners, or similar type fasteners.

Yet another object of the present invention is having the bib not comprise a cape liquid repellant layer or a neck band liquid repellant layer for tasks that do not involve any use of a significant amount of water or chemicals such as when just cutting or combing hair.

Yet another object of the present invention is having the bib further comprise a cape liquid repellent layer and the neck band further comprising a neck band liquid repellant layer sewn thereto the neck band absorbent layer such that the neck band absorbent layer is on an outside portion of the neck band liquid repellant layer.

Still yet another object of the present invention is having the towel cape and the neck band sewn together such that the first end and the second end of the neck band extend beyond a first inside edge of the first flap and a second inside edge of the second flap and the cape absorbent layer and the neck band absorbent layer are on one side and the cape liquid repellant layer and the neck band liquid repellant layer are on an opposite side.

Still yet another object of the present invention is having the cape absorbent layer and the cape liquid repellant layer sewn together along the first inside edge of the first flap and the second inside edge of the second flap from the neck band down to a first bottom edge of the first flap and to a second bottom edge of the second flap.

Yet still another object of the present invention is having the cape absorbent layer and the cape liquid repellant layer sewn together for approximately half way along a first outside edge of the first flap, starting at the first bottom edge of the first flap, and approximately half way along a second outside edge of the second flap, starting at the second bottom edge of the second flap.

Still yet another object of the present invention is having the cape liquid repellant layer made of a liquid repellant material such as vinyl or Gortex®.

Still yet another object of the present invention is having the neck band liquid repellant layer made of a liquid repellant material such as vinyl or Gortex®.

Yet another object of the present invention is providing a method for using the present invention to protect a user's clothing from spills and mishaps with the bib only having the cape absorbent layer and the neck band absorbent layer.

Yet another object of the present invention is providing a method for using the present invention to protect a user's clothing from spills and mishaps with the bib further comprising the cape liquid repellant layer and the neck band liquid repellant layer.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
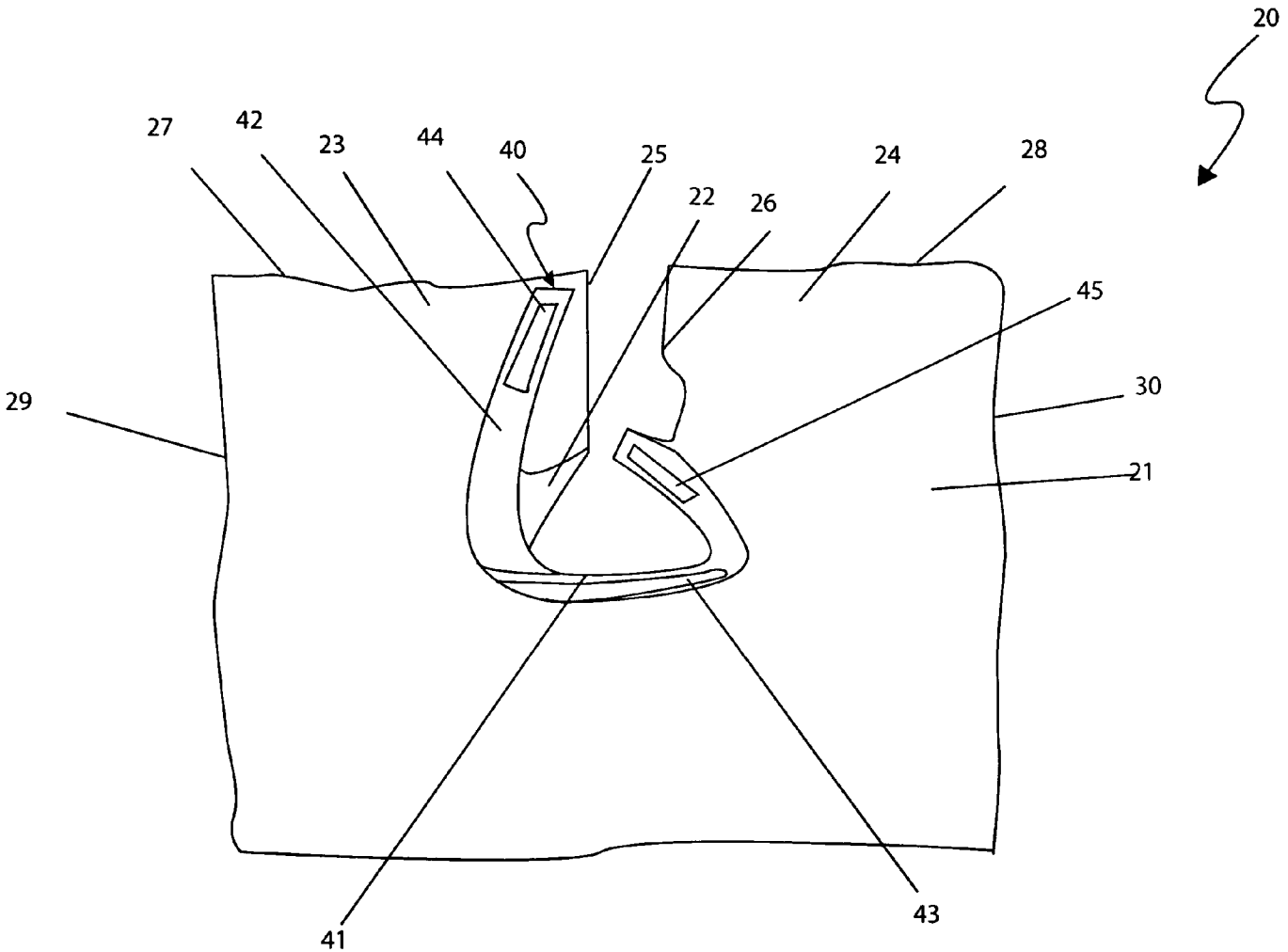
FIG. 1 is a front view of the under cape protector 10, according to a preferred embodiment of the present invention.

10 under cape protector
20 towel cape
21 cape absorbent layer
22 cape liquid repellant layer
23 first flap
24 second flap
25 inside edge of the first flap
26 inside edge of the second flap
27 bottom edge of the first flap
28 bottom edge of the second flap
29 outside edge of the first flap
30 outside edge of the second flap
40 neck band
41 neck band absorbent layer
42 neck band liquid repellant layer
43 neck strip
44 hook fastener
45 loop fastener
46 metal hook fastener
47 magnetic fastener
50 towel only cape
51 towel only cape absorbent layer
53 towel only first flap
54 towel only second flap
60 towel only neck band
61 towel only neck band absorbent layer
63 towel only neck strip
64 towel only hook fastener
65 towel only loop fastener
100 user

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for an under cape protector (herein described as the "device") 10, which provides a means for protecting a user's 100 clothing from spills and mishaps in beauty salons during shampooing and other hair and beauty treatments. The device 10 is placed underneath a vinyl protector commonly used in beauty salons during shampooing and other hair and beauty treatments. When used in this manner, it provides additional protection for a user's 100 clothing and ensures that water and other liquids that get underneath the vinyl protector will not contact the wearer's clothing. It is made of a soft absorbent material such as terry cloth and fastens about a neck of the user 100 with the aid of snap fasteners or a hook-and-loop fastening system such as Velcro®. It is perfect for eating messy foods in the home, in restaurants, or in locations where eating is awkward, such as in the car. It is also ideal for the elderly, the physically disabled, or others with diminished coordination that may frequently soil their clothes while eating.

Referring now to FIG. 1, a front view of the device 10, according to the preferred embodiment of the present invention, is disclosed. The device 10 comprises a towel cape 20, a cape absorbent layer 21, a cape liquid repellent layer 22, a first flap 23, a second flap 24, a neck band 40, a neck band absorbent layer 41, a neck band liquid repellant layer 42, a neck strip 43, a hook fastener 44, and a loop fastener 45.

The cape absorbent layer 21 and the neck band absorbent layer 41 are comprised of a soft, absorbent material such as terry cloth or the like. The cape liquid repellent layer 22, and the neck band liquid repellant layer 42, are comprised of material such as, but not limited to vinyl or Gortex®, or the like. The neck band 40 has hook-and-loop fasteners such as Velcro® attached to the distal ends such that the hook fastener 44 is sewn onto one end and a loop fastener 45 is sewn onto the other end however, it may also have fasteners such as, but not limited to metal hook fasteners, magnetic fasteners, snap fasteners, or the like. The neck band 40 has a neck band absorbent layer 41 and a neck band liquid repellent layer 42 sewn together such that the neck band absorbent layer 41 is on the outside. A neck strip 43 comprised of materials such as vinyl is sewn to the neck band absorbent layer 41 on to the outside of the neck band 40 and covers the portion of the neck band 40 that is over the user's 100 back when the device 10 is in place; however, other materials similar to vinyl may be used. The towel cape 20 and the neck band 40 are sewn together such that the ends of the neck band 40 extend beyond the first inside edge of the first flap 25 and the second inside edge of the second flap 26 and the cape absorbent layer 21 and the neck band absorbent layer 41 are on one side and the cape liquid repellent layer 22 and the neck band liquid repellent layer 42 are on the opposite side. The cape absorbent layer 21 and the cape liquid repellant layer 22 are also sewn together along the first inside edge of the first flap 25 and the second inside edge of the second flap 26 from the neck band 40 down to the first bottom edge of the first flap 27 and to the second bottom edge of the second flap 28 in the installed position (see FIG. 3). The cape absorbent layer 21 and the cape liquid repellant layer 22 are also sewn together for approximately half way along the first outside edge of the first flap 29, starting at the first bottom edge of the first flap 27, and approximately half way along the second outside edge of the second flap 30, starting at the second bottom edge of the second flap 28.

Figure 2:
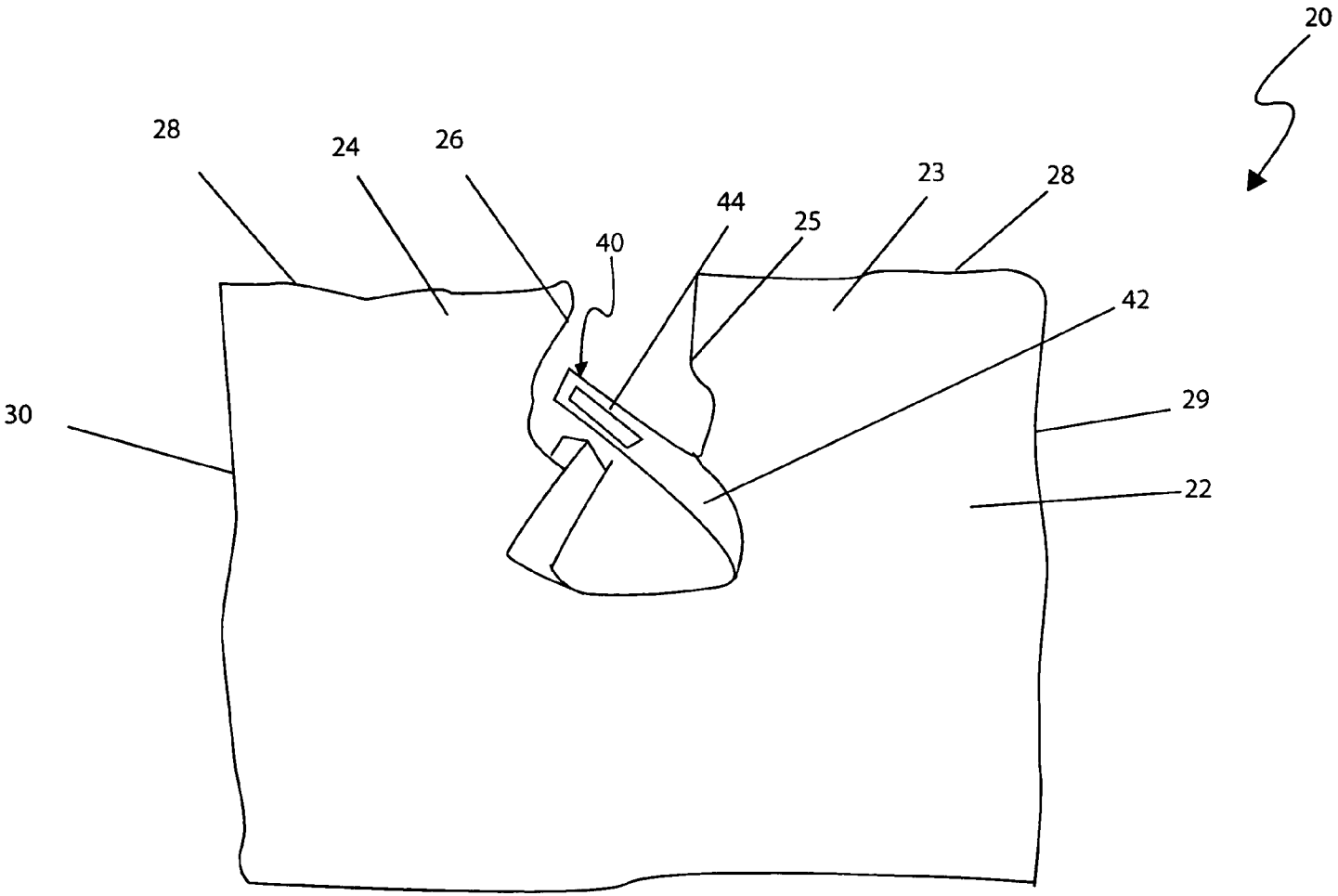
FIG. 2 is a rear view of the under cape protector 10, according to a preferred embodiment of the present invention.

Referring now to FIG. 2, a rear view of the device 10, according to the preferred embodiment of the present invention, is disclosed. The device 10 comprises a towel cape 20, a cape absorbent layer 21, a cape liquid repellent layer 22, a first flap 23, a second flap 24, a neck band 40, a neck band absorbent layer 41, a neck band liquid repellant layer 42, a neck strip 43, a hook fastener 44, and a loop fastener 45. The cape absorbent layer 21 is not shown in this view.

Figure 3:
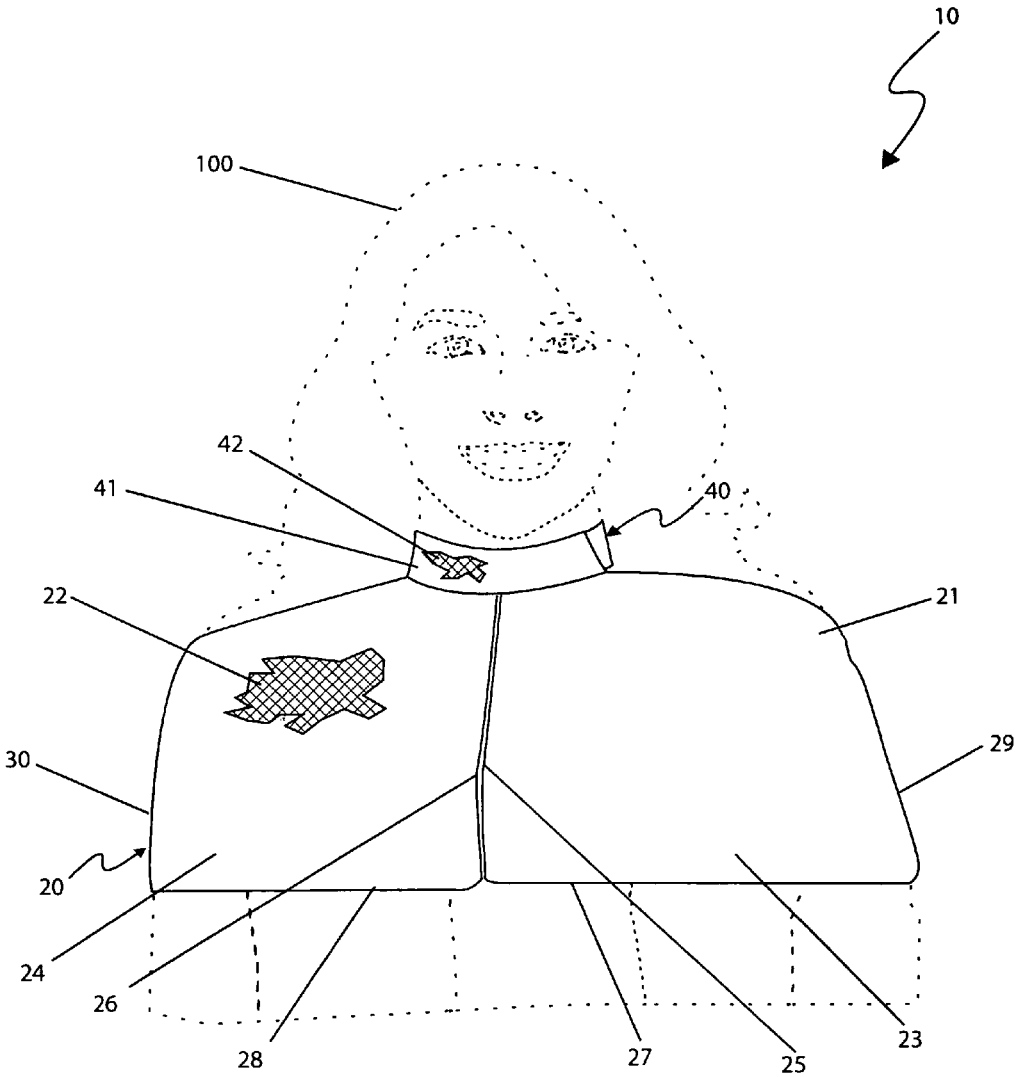
FIG. 3 is a front environmental cut-away view of the under cape protector 10, according to a preferred embodiment of the present invention.

Referring now to FIG. 3, a front environmental cut-away view of the device 10, according to the preferred embodiment of the present invention, is disclosed. This view illustrates how the preferred embodiment is to be worn by a user 100.

Figure 4:
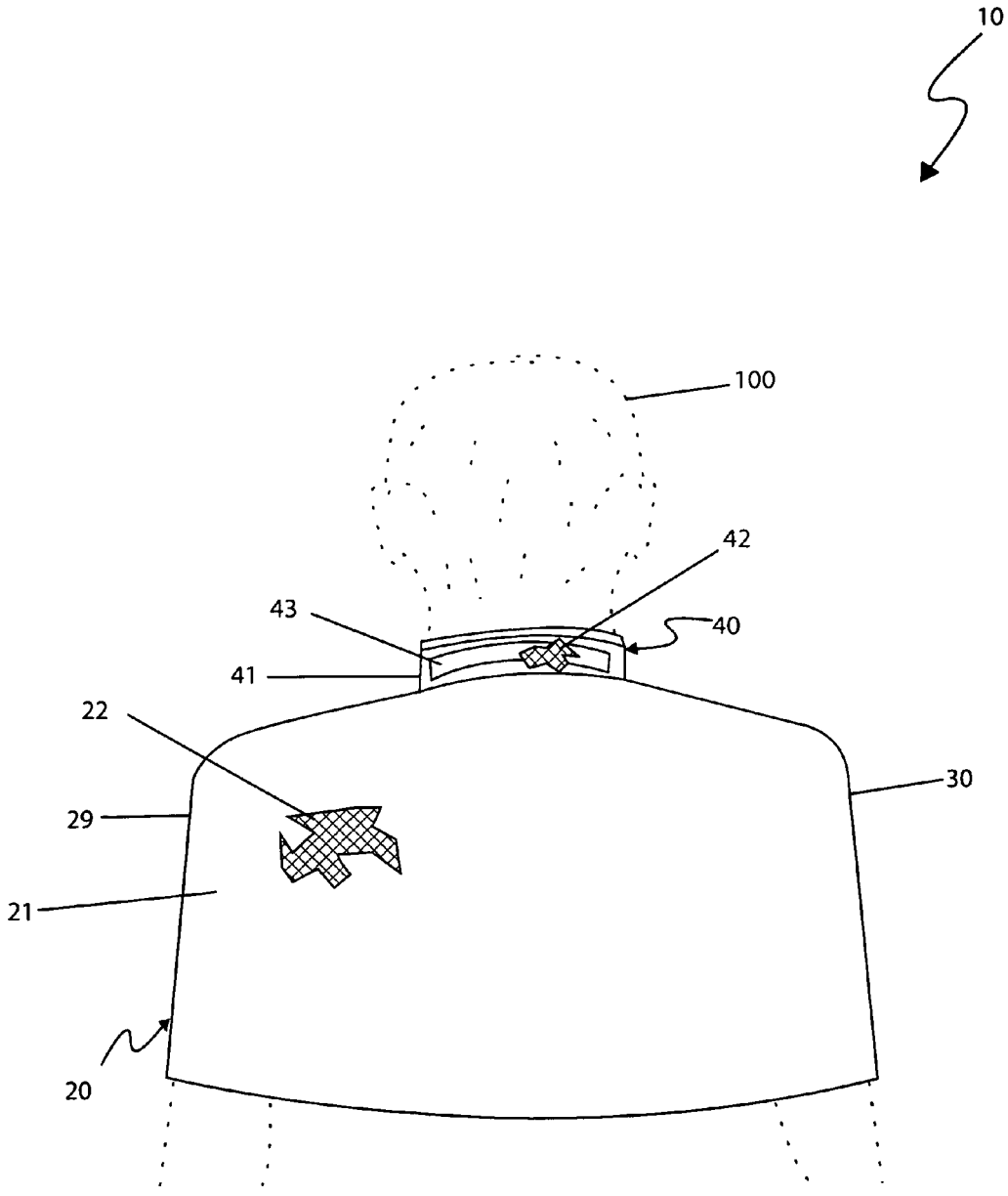
FIG. 4 is a rear environmental cut-away view of the under cape protector 10, according to a preferred embodiment of the present invention.

Referring now to FIG. 4, a rear environmental cut-away view of the device 10, according to the preferred embodiment of the present invention, is disclosed. The device 10 comprises a towel cape 20, a cape absorbent layer 21, a neck band 40, a neck band absorbent layer 41, and a neck strip 43. The neck strip 43 provides a cutting surface for cutting hair on the back of the neck.

Figure 5:
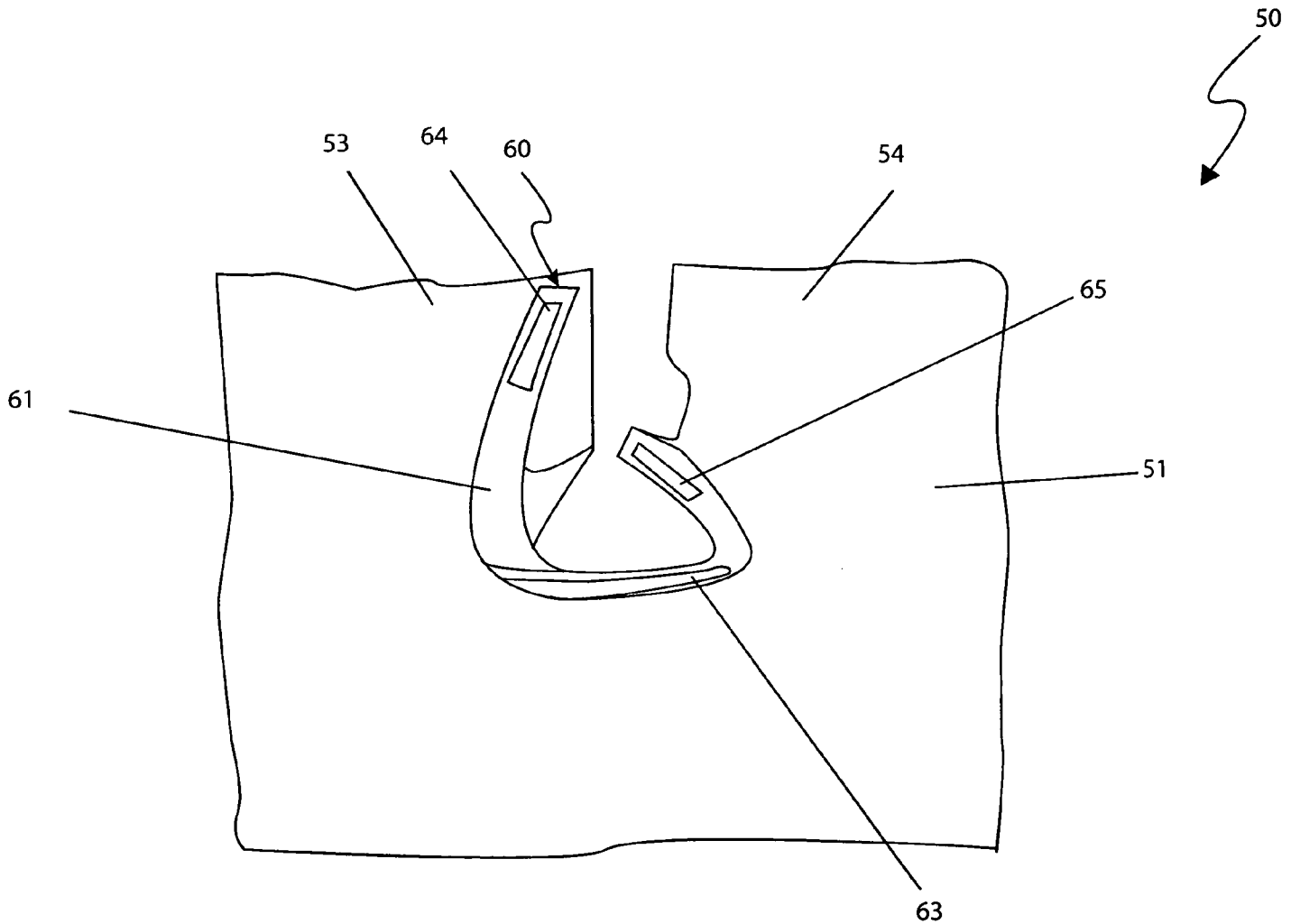
FIG. 5 is a front view of the under cape protector 10, according to an alternate embodiment of the present invention.

Referring now to FIG. 5, a front view of the device 10, according to an alternate embodiment of the present invention, is disclosed. The device 10 comprises a towel only cape 50, a towel only cape absorbent layer 51, a towel only first flap 53, a towel only second flap 54, a towel only neck band 60, a towel only neck band absorbent layer 61, a towel only neck strip 63, a towel only hook fastener 64, and a towel only loop fastener 65.

This alternate embodiment of the device 10 is the same as the preferred embodiment except that it does not comprise liquid repellent layers. It is envisioned that this alternate embodiment would be used for tasks that do not involve the use of significant amounts of water or chemicals such as when cutting or combing hair.

Figure 6:
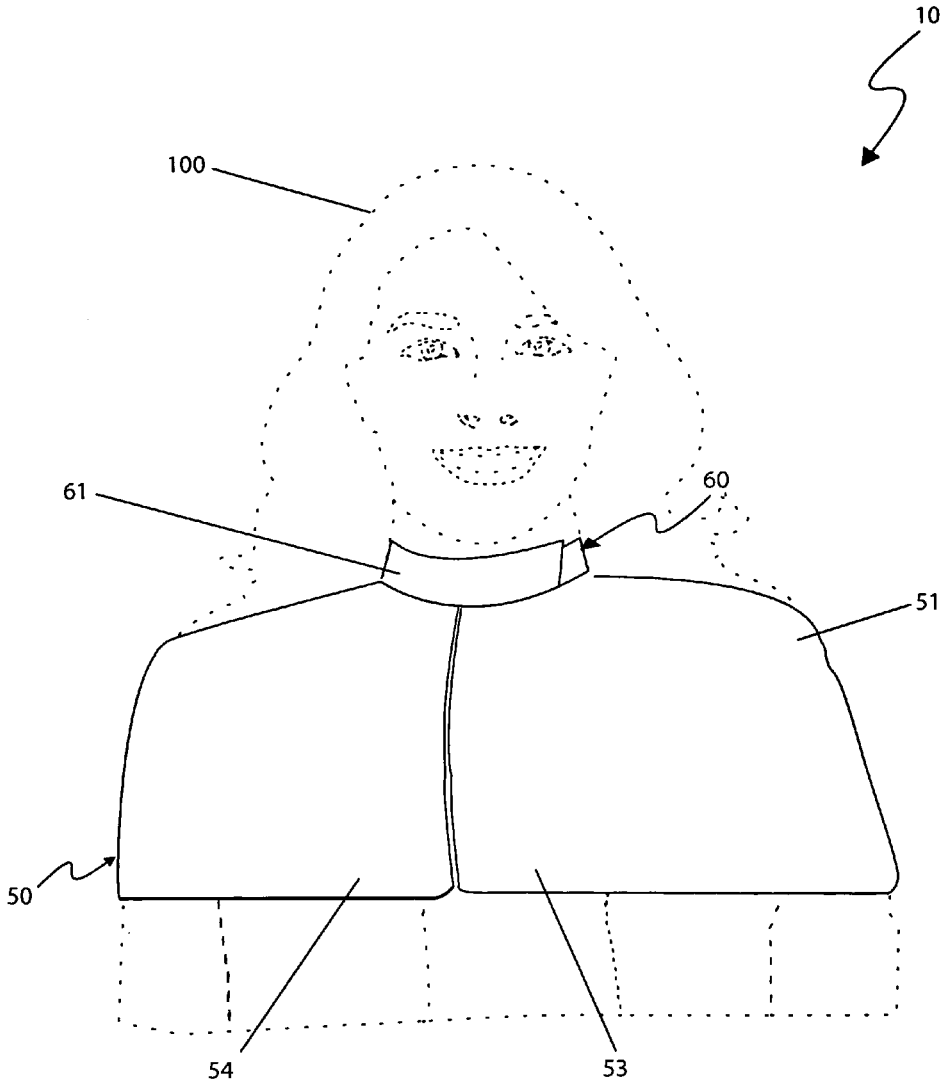
FIG. 6 is a front environmental view of the under cape protector 10, according to a alternate embodiment of the present invention; and, FIG. 7 is a rear environmental view of the under cape protector 10, according to an alternate embodiment of the present invention.

Referring now to FIG. 6, a front environmental view of the device 10, according to the alternate embodiment of the present invention, is disclosed. This view illustrates how the alternate embodiment is to be worn by a user 100.

Figure 7:
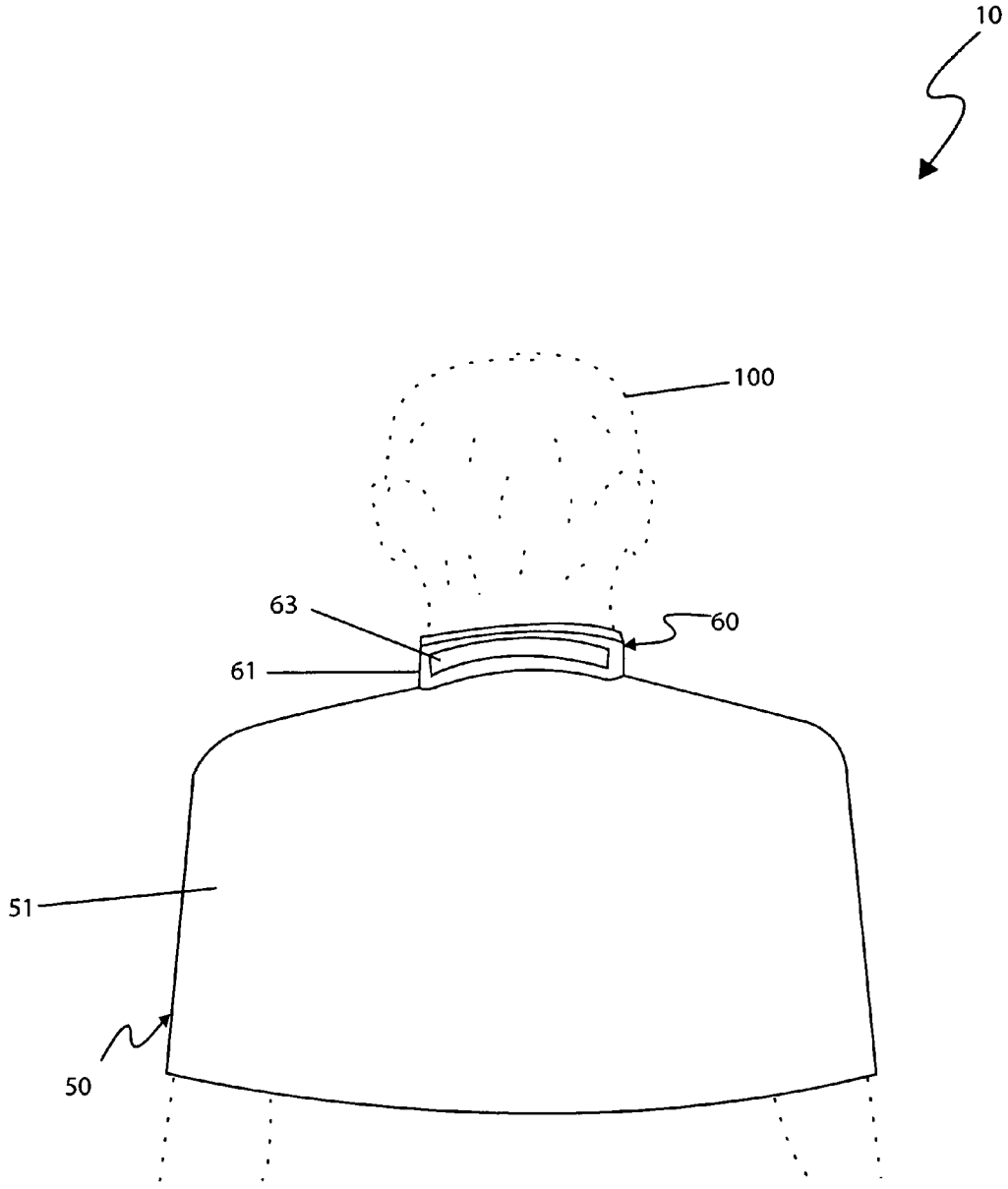

Referring now to FIG. 7, a rear environmental view of the device 10, according to the alternate embodiment of the present invention, is disclosed. The device 10 comprises a towel only cape 50, a towel only cape absorbent layer 51, a towel only neck band 60, a towel only neck band absorbent layer 61, and a towel only neck strip 63. The towel only neck strip 63 provides a cutting surface for cutting hair on the back of the neck.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 3 and 4.

The method of utilizing the preferred embodiment of the device 10 may be achieved by performing the following steps: placing the device 10 on the user 100 such that the cape liquid repellent layer 22 and the neck band liquid repellent layer 42 are on the inside against the user 100, the neck band 40 is around the user's 100 neck, and the first flap 23 and the second flap 24 are over the user's 100 chest; positioning the two distal ends of the neck band 40 such that the neck band 40 fits snug against the user's 100 neck; pressing the two ends of the neck band 40 together such that the hook fastener 44 engages the loop fastener 45 thereby affixing the ends of the neck band 40 together; positioning a vinyl protector (barber's cape) over the device 10 such that it is affixed to the user's 100 neck around the neck band 40 of the device 10 and is below the neck strip 43.

The alternate embodiment of the present invention can be utilized by the common user in a simple and effortless manner with little or no training. After initial purchase or acquisition of the device 10, it would be installed as indicated in FIGS. 6 and 7.

The method of utilizing the alternate embodiment of the device 10 may be achieved by performing the following steps: placing the device 10 on the user 100 such that the towel only neck band 60 is around the user's 100 neck, and the towel only first flap 53 and the towel only second flap 54 are over the user's 100 chest; positioning the two distal ends of the towel only neck band 60 such that the towel only neck band 60 fits snug against the user's 100 neck; pressing the two ends of the towel only neck band 60 together such that the towel only hook fastener 64 engages the towel only loop fastener 65 thereby affixing the ends of the towel only neck band 60 together; positioning a barber's cape over the device 10 such that it is affixed to the user's 100 neck around the towel only neck band 60 of the device 10 and is below the towel only neck strip 63.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A bib to protect a user's clothing from spills and mishaps, comprising:

a towel cape comprising:

a first flap;

a second flap; and, a cape absorbent layer;

a neck band sewn thereto said towel cape and comprising:

a first end;

a second end opposite said first end;

a neck band absorbent layer; and, a fastener system attached to said first end and said second end to removably secure said bib about a neck of a user;

a neck strip sewn to said neck band absorbent layer on to an outside portion of said neck band, wherein said neck strip covers a portion of said neck band that is over a user's back when said bib is in place; and, wherein said towel cape and said neck band are sewn together such that said first end and said second end of said neck band extend beyond a first inside edge of said first flap and a second inside edge of said second flap such that said cape absorbent layer and said neck band absorbent layer are on one side.

2. The bib of claim 1, wherein said cape absorbent layer is made of a soft, absorbent material.

3. The bib of claim 2, wherein said neck band absorbent layer is made of a soft, absorbent material.

4. The bib of claim 3, wherein said neck strip is made of a vinyl material.

5. The bib of claim 4, wherein said fastener system further comprises:

a hook fastener located on said first end of said neck band;

a loop fastener located on said second end of said neck band; and, said hook fastener engages said loop fastener when said first end and said second end of said neck band are pressed together thereby affixing said first end and said second end of said neck band together.

6. The bib of claim 4, wherein said fastener system comprises one of the following: metal hook fasteners, magnetic fasteners, or snap fasteners.

7. The bib of claim 4, wherein said bib is used for tasks that do not involve any use of a significant amount of water or chemicals such as when just cutting or combing hair.

8. The bib of claim 1, wherein said bib further comprises:

said towel cape further comprising a cape liquid repellent layer;

said neck band further comprising a neck band liquid repellant layer sewn thereto said neck band absorbent layer such that said neck band absorbent layer is on an outside portion of said neck band liquid repellant layer;

wherein said towel cape and said neck band are sewn together such that said first end and said second end of said neck band extend beyond said first inside edge of said first flap and said second inside edge of said second flap such that said cape absorbent layer and said neck band absorbent layer are on one side and said cape liquid repellant layer and said neck band liquid repellant layer are on an opposite side;

wherein said cape absorbent layer and said cape liquid repellant layer are sewn together along said first inside edge of said first flap and said second inside edge of said second flap from said neck band down to a first bottom edge of said first flap and to a second bottom edge of said second flap; and, wherein said cape absorbent layer and said cape liquid repellant layer are sewn together for approximately half way along a first outside edge of said first flap, starting at said first bottom edge of said first flap, and approximately half way along a second outside edge of said second flap, starting at said second bottom edge of said second flap.

9. The bib of claim 8, wherein said cape absorbent layer is made of a soft, absorbent material.

10. The bib of claim 9, wherein said neck band absorbent layer is made of a soft, absorbent material.

11. The bib of claim 10, wherein said neck strip is made of a vinyl material.

12. The bib of claim 11, wherein said cape liquid repellant layer is made of a liquid repellant material.

13. The bib of claim 12, wherein said neck band liquid repellant layer is made of a liquid repellant.

14. The bib of claim 13, wherein said fastener system further comprises:

a hook fastener located on said first end of said neck band;

a loop fastener located on said second end of said neck band; and, said hook fastener engages said loop fastener when said first end and said second end of said neck band are pressed together thereby affixing said first end and said second end of said neck band together.

15. The bib of claim 13, wherein said fastener system comprises one of the following: metal hook fasteners, magnetic fasteners, or snap fasteners, type fasteners.

16. A method for using a bib to protect a user's clothing from spills and mishaps, said method comprising the steps of:

providing said bib, comprising:

a towel cape comprising:

a first flap;

a second flap;

a cape absorbent layer; and, a cape liquid repellant layer;

a neck band sewn thereto said towel cape and comprising:

a first end;

a second end opposite said first end;

a neck band absorbent layer;

a fastener system attached to said first end and said second end to removably secure said bib about a neck of a user;

a neck strip sewn to said neck band absorbent layer on to an outside portion of said neck band, wherein said neck strip covers a portion of said neck band that is over a user's back when said bib is in place; and, wherein said towel cape and said neck band are sewn together such that said first end and said second end of said neck band extend beyond a first inside edge of said first flap and a second inside edge of said second flap such that said cape absorbent layer and said neck band absorbent layer are on one side;

placing said bib on said user such that said neck band is around said neck of said user, and said first flap and said second flap are over a chest of said user;

positioning said first end and said second end of said neck band such that said neck band fits snug against said neck of said user;

pressing said first end and said second end of said neck band together such that said fastener system removably secures said first end and said second end of said neck band together; and, positioning a barber's cape over said bib such that it is affixed to said neck of said user around said neck band of said bib and is below said neck strip.

17. A method for using a bib to protect a user's clothing from spills and mishaps, said method comprising the steps of:

providing said bib, comprising:

a towel cape comprising:

a first flap;

a second flap; and, a cape absorbent layer; and a cape liquid repellant layer;

a neck band sewn thereto said towel cape and comprising:

a first end;

a second end opposite said first end;

a neck band absorbent layer;

a neck band liquid repellant layer sewn thereto said neck band absorbent layer such that said neck band absorbent layer is on an outside portion of said neck band liquid repellant layer; and, a fastener system attached to said first end and said second end to removably secure said bib about a neck of a user;

a neck strip sewn to said neck band absorbent layer on to an outside portion of said neck band, wherein said neck strip covers a portion of said neck band that is over a user's back when said bib is in place; and, wherein said towel cape and said neck band are sewn together such that said first end and said second end of said neck band extend beyond a first inside edge of said first flap and a second inside edge of said second flap such that said cape absorbent layer and said neck band absorbent layer are on one side and said cape liquid repellant layer and said neck band liquid repellant layer are on an opposite side;

wherein said cape absorbent layer and said cape liquid repellant layer are sewn together along said first inside edge of said first flap and said second inside edge of said second flap from said neck band down to a first bottom edge of said first flap and to a second bottom edge of said second flap; and, wherein said cape absorbent layer and said cape liquid repellant layer are sewn together for approximately half way along a first outside edge of said first flap, starting at said first bottom edge of said first flap, and approximately half way along a second outside edge of said second flap, starting at said second bottom edge of said second flap;

placing said bib on a user such that said cape liquid repellent layer and said neck band liquid repellent layer are on the inside against said user, said neck band is around a neck of said user, and said first flap and said second flap are over a chest of said user;

positioning said first end and said second end of said neck band such that said neck band fits snug against said neck of said user;

pressing said first end and said second end of said neck band together such that said fastener system removably secures said first end and said second end of said neck band together; and, positioning a vinyl protector over said bib such that it is affixed to said neck of said user around said neck band of said bib and is below said neck strip.

* * * * *